United States Patent [19]

Rieth et al.

[11] 4,198,732

[45] Apr. 22, 1980

[54] ADJUSTABLE CLASP CONSTRUCTION FOR BRACELETS AND THE LIKE

[75] Inventors: Kurt A. Rieth, Warwick; Stephen F. Bert, West Warwick, both of R.I.

[73] Assignee: Textron, Inc., Providence, R.I.

[21] Appl. No.: 908,229

[22] Filed: May 22, 1978

[51] Int. Cl.[2] ..... A44B 11/25

[52] U.S. Cl. ..... 24/78; 24/191

[58] Field of Search ..... 24/170, 78, 77 R, 191, 24/192, 194, 171, 206 B

[56] References Cited

U.S. PATENT DOCUMENTS

| | | | |
|---|---|---|---|
| 422,088 | 2/1890 | MacMillan | 24/192 |
| 1,513,364 | 10/1924 | Bears | 24/191 |
| 2,015,038 | 9/1935 | Heer . | |
| 2,229,677 | 1/1941 | Schoeninger | 24/78 |
| 2,273,218 | 2/1942 | Prestinari . | |
| 3,339,248 | 9/1967 | Campaiola | 24/170 X |
| 3,425,104 | 2/1969 | Mochizuki | 24/78 X |
| 3,711,906 | 1/1973 | Leon | 24/78 X |
| 3,735,455 | 5/1973 | Hauser | 24/191 |
| 3,795,028 | 3/1974 | Weiss | 24/78 |

FOREIGN PATENT DOCUMENTS

| | | |
|---|---|---|
| 110260 | 9/1968 | Japan . |
| 89575 | 1/1978 | Japan . |
| 1138122 | 12/1968 | United Kingdom . |

*Primary Examiner*—Philip C. Kannan

*Attorney, Agent, or Firm*—Thompson, Birch, Gauthier & Samuels

[57] ABSTRACT

A clasp construction for use in adjustably interconnecting the free ends of a bracelet on the wrist of a wearer, including a clamp assembly that receives one of the free ends of the bracelet therein in slidable, adjustable relation and a coupling assembly that is secured to the other free end of the bracelet, the coupling assembly including a coupling member that engages the clamp assembly for removably mounting the bracelet on the wrist of the wearer.

9 Claims, 15 Drawing Figures

ADJUSTABLE CLASP CONSTRUCTION FOR BRACELETS AND THE LIKE

BACKGROUND OF THE INVENTION

There has been a long-felt need for an adjustable clasp for interconnecting end sections of a bracelet which is quickly and easily adjustable to fit the wearer's wrist by the retail dealer as well as by the wearer. More specifically, there has been a long-felt need for such a clasp in which all of the parts as well as the assembly are durable, which can be used with bracelets of different thicknesses and which does not damage any parts by excessive pressure of the clamping means against any other part of the assembly. There has also been a long-felt need for an adjustable clasp in which the clamping means securely holds the clasp in adjusted position but which can be easily opened by the user's fingernail without a tool. In addition there has been a long-felt need for such a clasp which presents an attractive exterior appearance. Furthermore, there has been a long-felt need for such a clasp the parts of which are economical to manufacture and to assemble.

Numerous prior art clasps have been disclosed which include a clamp assembly for receiving one end section of a bracelet in slidable, adjustable relationship and a coupling assembly which is secured to another end section of a bracelet and is detachably engagable with the clamp assembly for interlocking the bracelet on the wrist of the wearer.

In many of these prior clasps, the clamp assembly has included a bottom wall joined to a pair of spaced side walls which extend substantially normal thereto, pressure plate means, means for mounting the pressure plate means between the side walls for limited movements substantially normal to the bottom wall of the clamp assembly and rigid cam-like clamping means having one end pivotally mounted between the side walls above the pressure plate means so that at least one end portion of the clamping means engages the upper surface of the pressure plate means when the clamping means is rotated about is pivotal mounting and urges at least a lower portion of the lower surface of the pressure plate into frictional engagement with the upper surface of the bracelet section which is associated with the clamp assembly, thereby securing it in an adjusted position longitudinally of the bracelet section.

The coupling assembly which is secured to the end of the bracelet section is then detachably secured to the clamp assembly so that the bracelet encircles the wrist of the wearer.

In all of these prior art clasps of which we are aware, the clamping means is rotated about a fixed pivotal axis and its end portion which engages the upper surface of the pressure plate means is rigid. The thicknesses of bracelets vary substantially and the intensity of the force exerted upon the upper surface of the pressure plate means is increased as the thickness of the bracelet is increased thereby increasing the forces exerted by the rigid end of the clamping means against the upper surface of the pressure plate when the clamping means is rotated to its closed position. Consequently these prior art clasps are restricted either to use with bracelets of substantially the same thickness or it is necessary to provide a series of clamping means having end portions of different lengths or it is necessary to provide pressure plate means of different thicknesses since the clamping means must lock the end bracelet section with which it is associated in its adjusted position or it will slip out of the clamp assembly.

Examples of such prior art clasps are disclosed in the following prior patents and unpatented prior clasp:

Heer U.S. Pat. No. 2,015,308 dated Sept. 24, 1935; Shoeninger U.S. Pat. No. 2,229,677 dated Jan. 28, 1941; Prestinari U.S. Pat. No. 2,273,218 dated Feb. 17, 1942; Mochizuki U.S. Pat. No. 3,425,104 dated Feb. 24, 1969; and Weiss U.S. Pat. No. 3,795,028, application filed Dec. 27, 1971.

A watch bracelet made by Mochizuki Mfg. Co. of Tokyo, Japan by early 1977 in which the clamping means is substantially the same as Shoeninger's clamping means and includes a rigid cam end which is forced against the upper surface of a pressure plate when rotated to closed position.

Clamping assemblies which include rigid cam ends acting directly upon a bracelet section without an intervening pressure plate are disclosed in the following publication and patent:

Mochizuki Japanese Utility Model application No. 41-110,260 published Sept. 5, 1968; and Leon U.S. Pat. No. 3,711,906 dated Jan. 23, 1973.

While Weiss U.S. Pat. No. 3,795,028 dated Mar. 5, 1974 discloses a coupling assembly 18 which includes frame means, hook shaped tongue means 58 extending outwardly from one end of the frame means and which is detachably engagable with a cross pin means 26 of the clamp assembly 16 and a cover 66 comprising side flanges pivotally attached to the frame means, he uses protuberances 24 extending inwardly from the rigid side walls of his clamp assembly for detachably holding his cover in closed position. The cover must be opened at least once a day when the wearer of the bracelet removes the bracelet from his wrist and closed at least once a day when he places the bracelet on his wrist. Consequently Weiss' protuberances which frictionally engage the flanges of his cover either soon wear out or soon wear grooves in the flanges of the cover rendering one of them inoperative to detachably secure the cover in its closed position.

While British Pat. No. 1,138,122 dated Dec. 28, 1968 discloses a bracelet which has a cover 21 having side flanges 19, 20 which are pivotally secured to a bracelet section 1 and the side flange 20 has an inwardly extending detent 22 engagable in the open end 12 of the part 4, both the top wall of the part 4 and the flange 20 are rigid so that either the detent or the end wall soon wear rendering them inoperative to hold the cover in its closed position.

Examples of other prior art coupling assemblies having covers which have not satisfied the long-felt need are:

Mochizuki Japanese Utility Model application 41-110260 published Sept. 5, 1968; Mochizuki U.S. Pat. No. 3,425,104 dated Feb. 4, 1969; Leon U.S. Pat. No. 3,711,906 dated Jan. 23, 1973; A watch bracelet made by Mochizuki Mfg. Co. of Tokyo Japan by early 1977; and Mochizuki Japanese Utility Model application 51-89575 published Jan. 24, 1978.

The above described prior art is the closest prior art of which we are aware to an adjustable clasp for interconnecting end sections of a bracelet on the wrist of a wearer embodying our invention as described and claimed in this application.

BRIEF SUMMARY OF THE INVENTION

One object of this invention is to provide an adjustable clasp for interconnecting end sections of a bracelet on the wrist of a wearer of a wrist watch bracelet, identification bracelet and the like which permits the length of the bracelet to be quickly and easily adjusted (1) by a retail dealer to fit different size wrists of customers and (2) by the wearer of the bracelet to fit his own wrist.

Another object is to provide such an adjustable clasp which is economical to manufacture and assemble.

Another object is to provide such an adjustable clasp which can be used with bracelets of varying thicknesses without damage to the parts.

A further object is to provide such an adjustable clasp in which the cover can be detachably held in closed position during repeated opening and closing of the cover without undue wearing of the parts.

A still further object is to provide such an adjustable clasp which is easy to disassemble for repair.

Yet a further object is to provide such an adjustable clasp which is attractive in appearance because it is thinner than the prior art.

Another object is to provide such an adjustable clasp in which the clamping means securely holds the clasp in adjusted position but can be easily opened by the user's fingernail without a tool.

Further objects and advantages of this invention will be apparent to persons skilled in the art from the following description taken in conjunction with the accompanying drawings.

In general, an adjustable clasp embodying this invention includes a clamp assembly for receiving one of the bracelet sections in slidable, adjustable relation and a coupling assembly secured to the other bracelet section which is engagable with the clamp assembly for interlocking the bracelet on the wrist of a wearer. The clamp assembly comprises a bottom wall, opposed side walls joined to the bottom wall extending substantially normal thereto, pressure plate means, and means for mounting the pressure plate means between said side walls for limited movement substantially normal to the bottom wall of the clamp assembly. The clamping means includes means for pivotally mounting one of its ends between the side walls of the clamp assembly above a portion of the pressure plate means. The clamping means also comprises a resilient member at least one portion of which engages the upper surface of the pressure plate means when the clamping means is rotated about the pivotal mounting means to closed position and thereby urges at least a portion of the lower surface of the pressure plate means into frictional engagement with the underlying bracelet section.

In a preferred embodiment, the clamping means includes an upper member one end of which is pivotally mounted between the side walls of the clamp assembly and a lower member integral with the other end of the upper member, at least one portion of the lower member comprises a resilient member which engages the upper surface of the pressure plate means when the clamping means is rotated about its pivotal mounting and urges at least a portion of the lower surface of the pressure plate means into frictional engagement with the underlying bracelet section.

In one embodiment of the invention, the upper member of the clamping means includes a pair of tab means extending downwardly from opposite sides of the upper member and inwardly beneath the lower surface of the lower member intermediate its ends, thereby to control the force exerted by the resilient member upon the upper surface of the pressure plate.

In another embodiment the lower member also includes groove means in its lower surface for receiving the ends of the tab means.

In yet another embodiment, the upper surface of the pressure plate means comprises a concave portion and the free end of the resilient member slidably engages the upper surface of this concave portion during at least a portion of the rotary movement of the clamping means towards its closed position.

In a further embodiment the lower surface of the free end of the resilient member is convex for slidably engaging the upper surface of the concave portion of the pressure plate means during the rotary movement of the clamping means towards its closed position.

In a still further embodiment, the concave portion of the pressure plate means is formed between two spaced bends which are generally parallel to the axis of the means for pivotally mounting the clamping means between said side walls and a portion of the free end of the resilient member engages at least the bend which is adjacent to the free end of said resilient member when the clamping means is in its closed position.

In yet another embodiment, the means for mounting the pressure plate means comprises extension members which project outwardly from the ends of the pressure plate means and orifices in the opposed side walls for receiving those extension members and one end of the pressure plate means comprises U-shaped notch means the length of which is greater than the distance between one of the orifices and the upper edge of the adjacent side wall, whereby the extension members of the pressure plate means can be mounted in those orifices without deformation thereof and without deformation of the side walls.

In a still further embodiment, the clamp assembly also includes cross pin means extending between its side walls, and the coupling assembly includes frame means, hook shaped tongue means extending outwardly from one end of the frame means. The tongue means is detachably engagable with the cross pin means for interconnecting the coupling assembly to the clamp assembly. The coupling assembly also includes a cover member comprising a curved plate having side flanges and means for pivotally connecting the side flanges to the frame means. The flanges of the cover include outwardly extending projection means which are engagable with portions of the side walls of the coupling assembly when the cover member is moved about its pivot means into overlying relation with the clamp assembly.

In yet another embodiment, the bottom wall of the clamp assembly comprises a generally U-shaped opening extending inwardly from one of its ends making the adjacent portions of the side walls of the clamp assembly more resilient for permitting the outwardly extending projection means of the cover to pass between the resilient portions of the side walls with less friction.

In another embodiment, the pressure plate means includes outwardly projecting means adjacent to one of its ends and the means for mounting the pressure plate between the side walls of the clamp assembly comprises orifices in those side walls which receive the outwardly projecting means of the pressure plate means and which also detachably receive the outwardly extending projections of the flanges of the cover when it is in its closed position.

In a still further embodiment, the means for pivotally connecting the side flanges of the cover to the frame means includes orifices in the side flanges of the cover, a pair of side flanges on the frame means, orifices in the side flanges of the frame means and spring pin means extending transversely of the frame means with the outer ends of its trunions received in the registering orifices of the flange means of the cover and of the frame means.

In yet another embodiment, the frame means comprises substantially U-shaped groove means for receiving the major portion of the spring pin means.

In a further embodiment, the frame means comprises an extension member at its end which is opposite to the tongue means for securing the coupling assembly to the other bracelet section.

It will be apparent to persons skilled in the art that this invention has solved the above described long-felt needs and satisfied the above described objects.

DETAILED DESCRIPTION OF THE INVENTION

Figure 1:
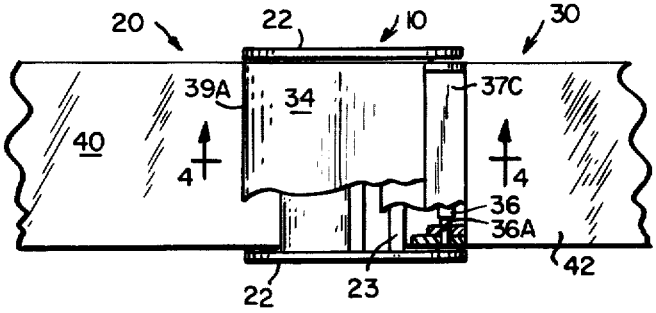
FIG. 1 is a top plan view of an adjustable clasp embodying the invention with parts broken away.
Figure 2:
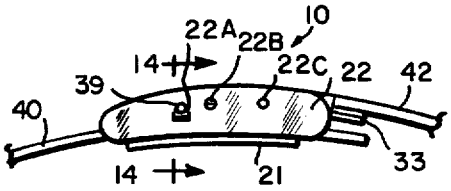
FIG. 2 is a side elevation of the adjustable clasp shown in FIG. 1.
Figure 3:
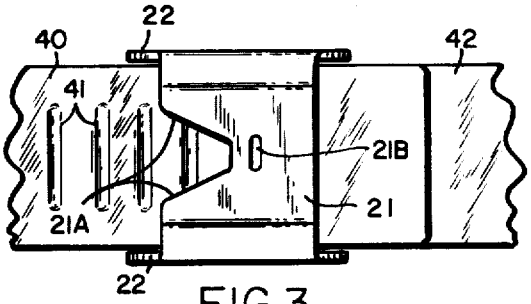
FIG. 3 is a bottom plan view of the adjustable clasp shown in FIG. 1.

Referring now to the drawings an adjustable clasp embodying the invention is generally indicated at 10. It has general application to a wrist watch bracelet or band, an identification bracelet or the like. It permits the length of the bracelet to be quickly and easily adjusted by a retail dealer to fit different size wrists of customers or by the user to fit his own wrist. The cover can also be easily opened by the user each day when he puts the bracelet or band on his wrist and when he removes it from his wrist by using his fingernail without a tool. It can be used with bracelets of varying thicknesses.

The adjustable clasp, indicated generally by the numeral 10, comprises a clamp assembly 20 and a coupling assembly 30.

The clamp assembly adjustably receives one end section 40 of a bracelet the other end of which may be connected to a watch or the like (not shown). The coupling assembly is secured to another end section 42 of a bracelet and its other end may be connected to the other end of a watch or the like (not shown). The bracelet sections shown in the drawings are made of wire mesh but they may be made of any other materials as is well known in the art.

In the preferred embodiment shown in FIGS. 3, 4, 5 and 6, the bottom surface of the bracelet section 40 is provided with a series of parallel grooves or recesses 41 which extend upwardly from its bottom surface, the function of which will be described infra.

Figure 4:
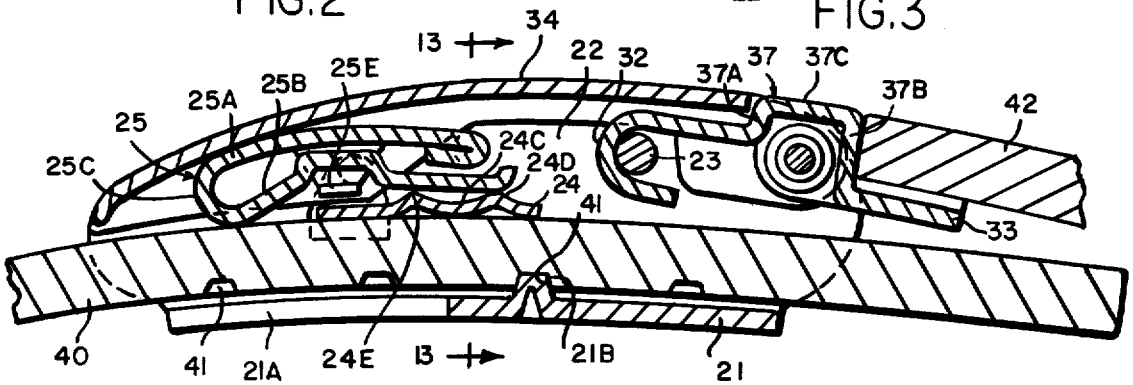
FIG. 4 is an enlarged section taken on the lines 4—4 of FIG. 1.
Figure 5:
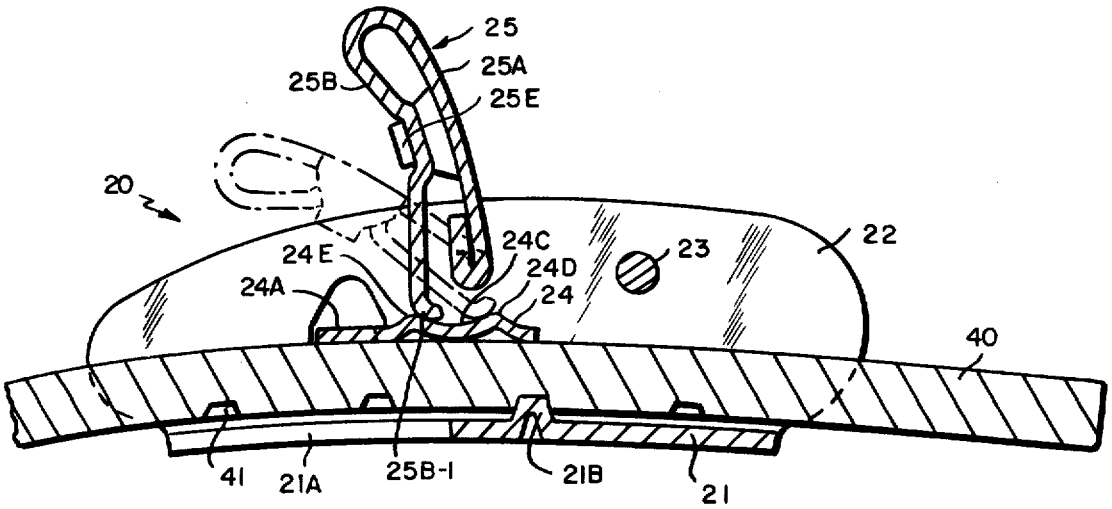
FIG. 5 is an enlarged section like FIG. 4 but with the coupling assembly removed, the clamping means being shown in open position in full lines and in partially closed position in dot dash lines.
Figure 6:
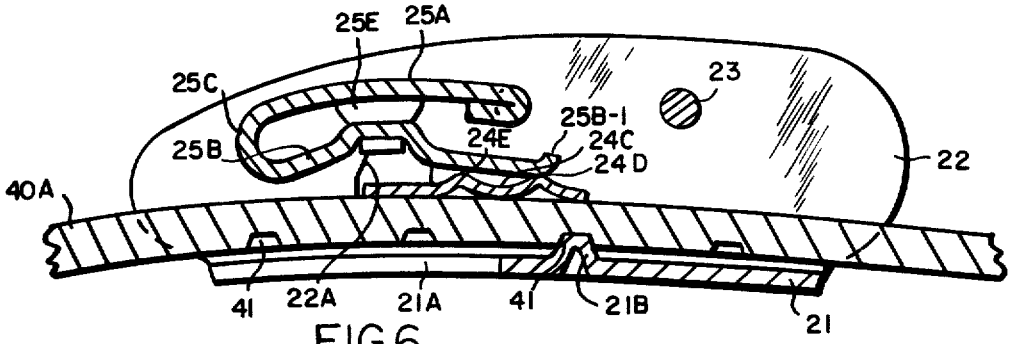
FIG. 6 is an enlarged section like FIG. 5 but showing a bracelet having a thinner cross section and with the clamping means shown in fully closed position.

The bracelet section 40 shown in FIGS. 4 and 5 is thicker than the bracelet section 40A shown in FIG. 6. The clamp assembly of this invention functions satisfactorily with bracelets of different thicknesses without changing any of its parts.

Figure 7:
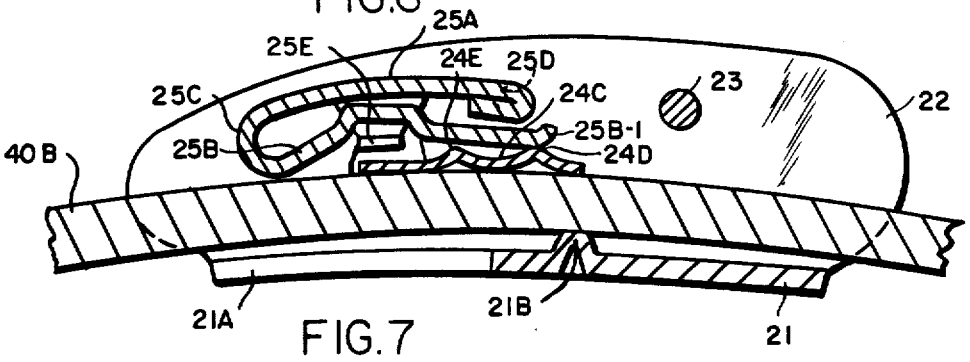
FIG. 7 is a section like FIG. 5 but showing a bracelet having the same thickness as the bracelet shown in FIG. 5 but with no recesses in its lower surface and with the clamping means shown in fully closed position.

The bottom surface of the bracelet section 40B shown in FIG. 7 is not provided with grooves or recesses 41. The clamp assembly of this invention functions satisfactorily with bracelets which are not provided with such grooves or recesses.

Referring now to the elements of clamp assembly, it comprises a bottom wall 21 and opposed side walls 22 which are joined to it and extend upwardly substantially normal thereto. The bottom wall is provided with a generally U-shaped opening 21A (FIG. 3) which extends inwardly from one of its ends and this opening makes the adjacent portions of the side walls 22 more resilient which is desirable for a reason to be described infra.

In the preferred embodiment the bottom wall is also provided with an upwardly extending projection 21B which is positioned in one of the recesses or grooves 41 of the bracelet section 40 when the clamping means is closed, as shown in FIGS. 4, 5 and 6 thereby to more securely hold the bracelet section 40 or 40A in adjusted relationship relative to the clamp assembly.

Figure 8:
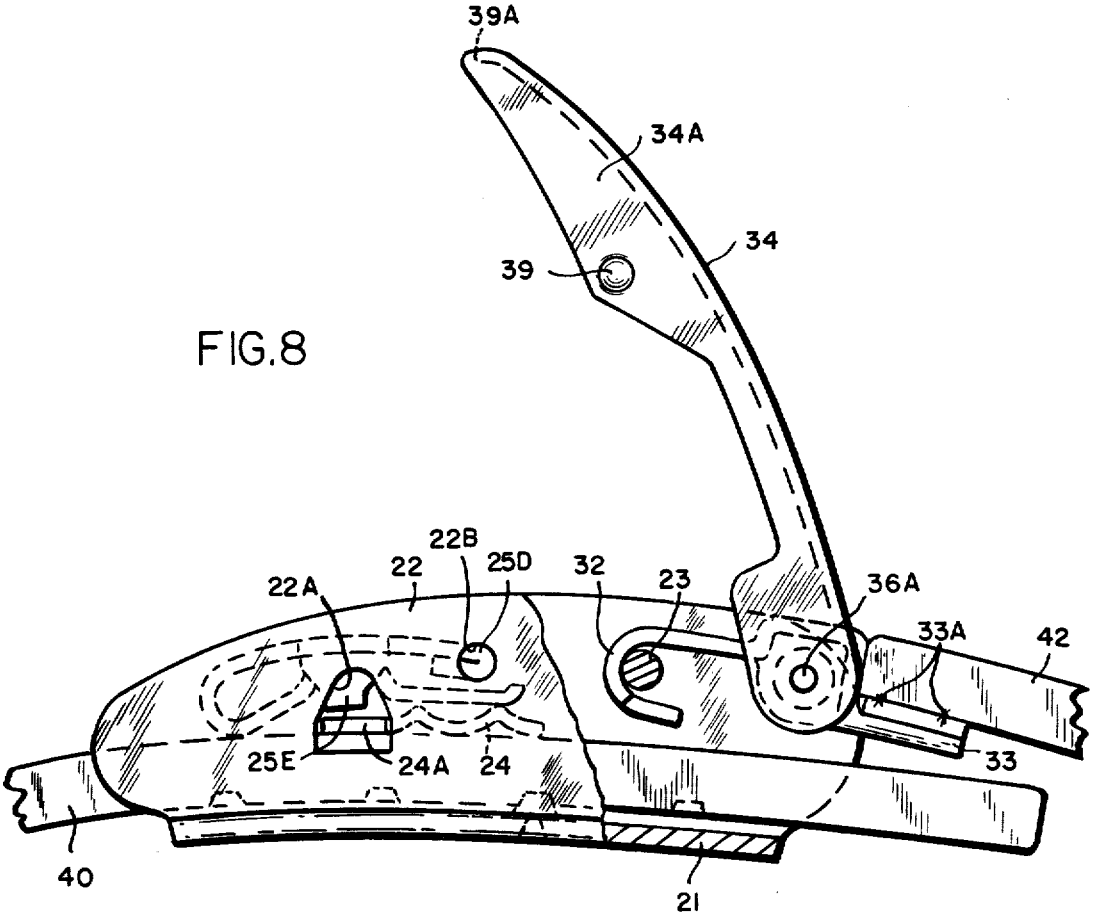
FIG. 8 is a side elevation of the adjustable clasp with the clamp assembly broken away to show the coupling assembly with its cover member in partially open position.

The side walls 22 are each provided with three orifices, an enlarged orifice 22A and generally circular orifices 22B and 22C. As best shown in FIG. 8 the lower portion of the orifice 22A has sides which are vertical and then converge to a concave upper wall.

A cross pin 23 extends between the side walls 22.

Figure 14:
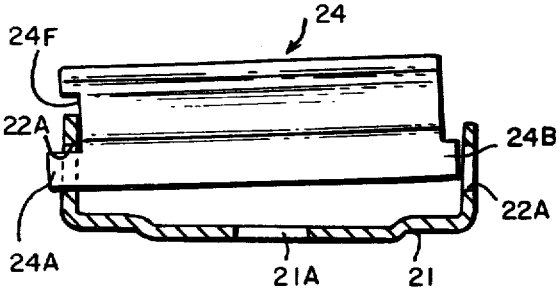
FIG. 14 is a section taken on the line 14—14 of FIG. 2 with the coupling assembly removed and showing the pressure plate means with one of its end extension members inserted in one of the orifices in a side wall of the clamp assembly.
Figure 15:
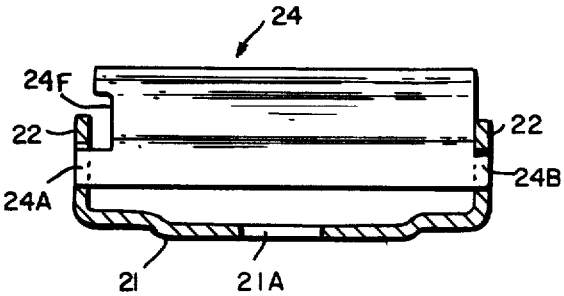
FIG. 15 is a view like FIG. 14 but with the pressure plate shown after its other end extension member has been inserted in the orifice of the opposite side wall of the clamp assembly.

As best shown in FIGS. 8, 14 and 15, the pressure plate means 24 is provided with a pair of extension members 24A and 24B which are generally rectangular in cross section and extend outwardly into the orifices 22A of the side walls 22. These extension members in combination with these orifices function to mount the pressure plate for limited movement substantially normal to the bottom wall 21 thereby to permit the end of the bracelet section 40, 40A or 40B to be inserted between the bottom wall and the bottom surface of the pressure plate when the clamping means 25 is in fully open position (not shown).

As best shown in FIGS. 14 and 15 one end of the pressure plate means 24 is provided with a generally U-shaped notch 24F. The length of this notch is greater than the distance between the upper edge of the orifice 22A in one of the side walls 22 and the upper edge of the side wall so that the pressure plate may be installed between the side walls by first inserting the extension member 24A in a notch 22A as shown in FIG. 14, then lowering the other end of the pressure plate and inserting the other extension member 24B in the orifice 22A in the opposite side wall as shown in FIG. 15. Thus the pressure plate may be quickly and easily installed between the side walls without deformation of the pressure plate or the side walls.

The upper surface of the pressure plate means is provided with a concave portion 24C. Preferably this concave portion is formed by a pair of substantially parallel spaced bends 24D and 24E which extend transversely of the pressure plate.

Figure 11:
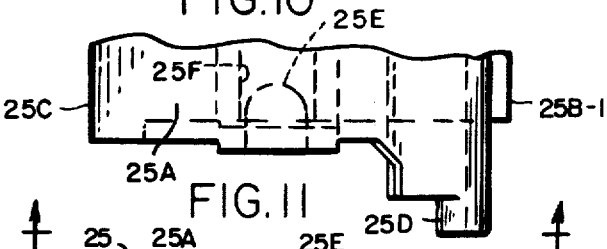
FIG. 11 is an enlarged plan view of one end of the clamping means.
Figure 13:
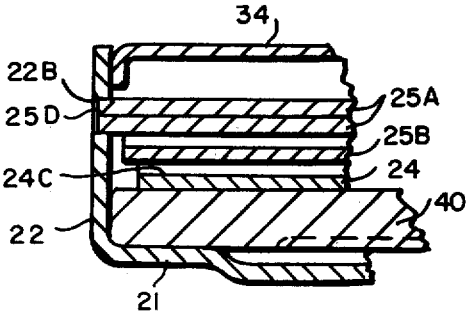
FIG. 13 is a section taken on the line 13—13 of FIG. 4.
Figure 12:
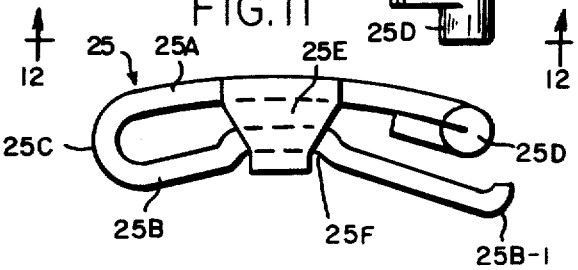
FIG. 12 is a side elevation of the clamping means shown in FIG. 11.

The clamping means 25 comprises an upper member 25A and a lower member 25B which is integral with one end of the upper member at the bend 25C. This clamping means is pivotally mounted between the side walls 22 by outwardly extending projections 25D which are formed on the other end of the upper member as best shown in FIGS. 11, 12 and 13. These projections extend into the orifices 22B of the side walls as shown in FIG. 13.

The lower member 25B is resilient. Preferably its tip 25B-1 is provided with a convex lower surface which slidably engages the concave upper surface 24C of the pressure plate means when the clamping means is rotated from the full line position to the dot-dash position of FIG. 5. When the clamping means is rotated from the dot-dash position of FIG. 5 to its fully closed position of FIG. 6, the lower surface of the tip of the lower member engages the upper surface of the bend 24D and thereby urges a portion of the lower surface of the pressure plate means into frictional engagement with the upper surface of the bracelet section 40A as shown in FIG. 4. This forces the projection 21B into frictional engagement with a selected groove 41 of the bracelet section 40, 40A as shown in FIGS. 4 and 6. Thus the bracelet section 40 or 40A is locked in its adjusted position relative to the clamp assembly.

When the bracelet section 40B is not provided with grooves 41 it is locked in adjusted position merely by forcing the lower surface of the bracelet section into frictional engagement with the projection 21B as shown in FIG. 7. The clamping means of this invention will also work satisfactorily if the projection 21B of the bottom wall is omitted.

According to the preferred embodiment the upper member 25A of the clamping means is provided with a pair of tab means 25E which extend downwardly from opposite sides thereof and inwardly beneath the lower surface of the lower member intermediate its ends (FIGS. 4, 5, 6, 11 and 12). These tab means function to control the force exerted by the resilient member 25B upon the upper surface of the pressure plate means; compare its positions in FIGS. 4 and 5. Preferably the lower member 25B is provided with groove means 25F (FIGS. 11 & 12) which extends transversely of its lower surface and the ends of the tab means are received in this groove. This permits making a thinner and more attractive clasp assembly.

It will be observed that in the closed position of the clamping means the line of contact 24D between the resilient member and the pressure plate is located to the right of the axis of the pivotal extensions 25D as shown in FIGS. 4, 6, 7 and 8. Consequently the clamping means is resiliently urged to closed position and the retail dealer or the user can easily move it to open position for adjusting the length of the bracelet by merely inserting his fingernail beneath bend 25C without using a tool.

The resiliency of portions of the side walls created by the U-shaped notch 21A in the bottom wall facilitates insertion of the pressure plate pivots 24A and 24B in the orifices 22A of the side walls 22.

Figure 9:
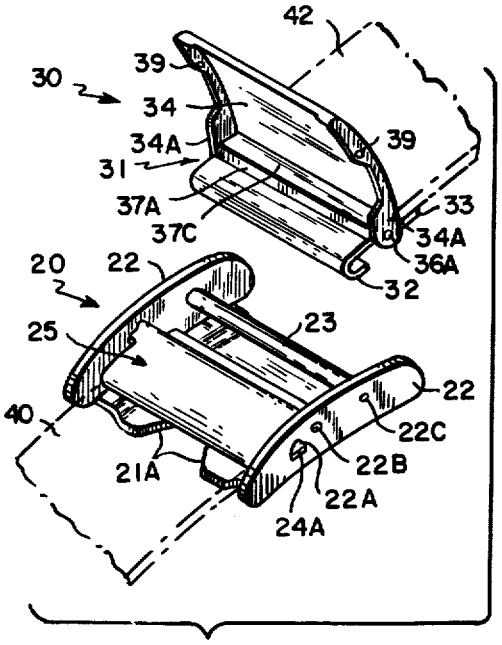
FIG. 9 is an exploded isometric view showing the coupling assembly in position to be detachably connected to the clamp assembly.

Turning now to the coupling assembly 30, it comprises frame means which is indicated generally by the numeral 31 in FIG. 9. The hook shaped tongue means 32 extends outwardly from one end of the frame means and it is detachably engagable with the cross pin 23 for interconnecting the coupling assembly with the clasp assembly.

The extension member 33 is integral with the opposite end of the frame means and it is secured to the end of the bracelet section 42 by any suitable means, for example by weldments 33A.

The cover 34 comprises a curved plate having downwardly extending side flanges 34A which have orifices 34B for use in pivotally mounting the cover on the frame means.

Figure 10:
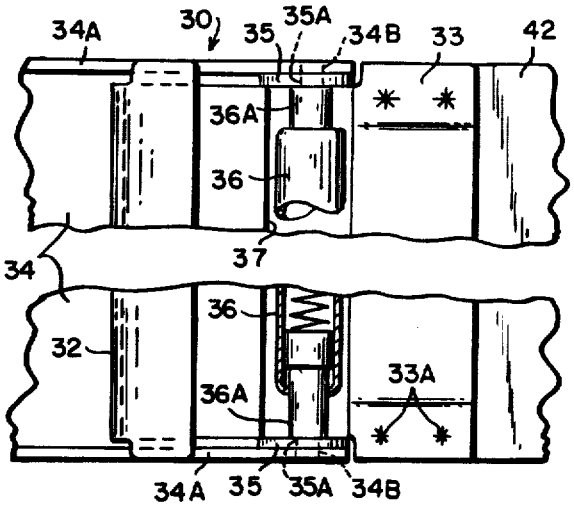
FIG. 10 is an enlarged bottom view of the coupling assembly with parts broken away along its longitudinal centerline and to show the interior of one end of the spring pin means.

The frame means also comprises a pair of downwardly extending flanges 35 which are provided with orifices 35A which register with the orifices 34B of the flanges 34A of the cover as shown in FIG. 10.

The spring pin means 36 extends transversely of the frame means and its trunions 36A pass thru the registering orifices 35A and 34B thereby mounting the cover for pivotal movement relative to the frame. This spring pin means is of the same construction as the spring pins used to detachably connect the ends of a watch bracelet between the lugs of a wrist watch. It can be easily installed by inserting one of its trunions in a pair of registering orifices 35A and 34B, then depressing the other trunion against its spring and mounting that trunion in the opposite pair of registering orifices by releasing the pressure against the end of the trunion so that the spring urges it into the registering orifices. Use of a spring pin for pivotal mounting of the cover not only permits easy removal of the cover for repair but also consumes much less time to install it than the prior art use of a solid pin.

In the preferred embodiment U-shaped groove means 37 extending transversely of the frame is provided by the side flanges 37A, 37B and the top wall portion 37C of the frame (FIG. 4). The spring pin is received in this groove. This provides a thinner and more attractive adjustable clasp.

In its closed position the flanges 34A of the cover are positioned inwardly of the side walls 22 of the clamp assembly. The flanges of the cover are provided with small outwardly extending projections 39 (FIG. 9). When the cover is closed these projections frictionally engage the inner surfaces of the side walls 22. Due to the provisions of the generally U-shaped opening 21A in the bottom wall 21, the side walls 22 are resilient so that the friction created by closing the cover is reduced preventing premature wearing of the ends of the projections 39.

In closed position of the cover the projections 39 enter the upper portions of the orifices 22A of the side walls 22 and this more securely holds the cover in its closed position. However, due to the resiliency of the side walls 22, the cover can be easily opened by the wearer inserting the end of his fingernail beneath the end 39A of the cover and lifting it.

All of the parts of the clamp assembly may be made of stainless steel.

Adjustable clasps embodying this invention have satisfied the above described objects and have provided the above described advantages.

While several desirable embodiments of adjustable clasps embodying the invention have been shown in the drawings, and described in the specification, it is to be understood that this disclosure is for the purpose of illustration only, and that various changes in shape, proportion and arrangement of parts as well as the substitution of equivalent elements for those shown and described herein may be made without departing from the spirit and scope of the invention as set forth in the appended claims.

We claim:

1. In an adjustable clasp for interconnecting end sections of a bracelet on the wrist of a wearer including in combination, a clamp assembly for receiving one of the bracelet sections in slidable, adjustable relation, and a coupling assembly secured to the other bracelet section and being engagable with said clamp assembly for interlocking the bracelet on the wrist of a wearer, said clamp assembly comprising, a bottom wall opposed side walls joined to the bottom wall and extending substantially normal thereto, pressure plate means, and means for mounting the pressure plate means between said side walls for limited movement substantially normal to said bottom wall of said clamp assembly, the improvement comprising, clamping means, means for pivotally mounting one end of said clamping means between said side walls of the clamp assembly above a portion of said pressure plate means, said clamping means comprising an upper member one end of which is pivotally mounted between said walls and a lower member integral with the other end of the upper member and generally parallel thereto, at least the free end portion of said lower member comprising a resilient member which engages the upper surface of said pressure plate means when said clamping means is rotated about its said pivotal mounting means to closed position and thereby urges at least a portion of the lower surface of said pressure plate means into frictional engagement with said one bracelet section.

2. An adjustable clasp according to claim 1 wherein the upper surface of said pressure plate means comprises a concave portion formed between two spaced upwardly extending bends the apexes of which are generally parallel to the axis of said means for pivotally mounting said clamping means between said side walls, said bends being located at opposite sides of said axis when the pressure plate is viewed from the side and the free end of said resilient member slidably engaging the upper surface of said concave portion during at least a portion of the rotary movement of said clamping means towards its closed position.

3. An adjustable clasp according to claim 2 wherein the lower surface of said free end of the resilient member is upwardly convex when the clamping means is in its closed position.

4. An adjustable clasp according to claim 2 wherein a portion of the free end of said resilient member engages the apex of the bend which is adjacent to one end of said pressure plate means when the clamping means is in its closed position.

5. In an adjustable clasp for interconnecting end sections of a bracelet on the wrist of a wearer including in combination, a clamp assembly for receiving one of the bracelet sections in slidable, adjustable relation, and a coupling assembly secured to the other bracelet section and being engagable with said clamp assembly for interlocking the bracelet on the wrist of a wearer, said clamp assembly comprising, a bottom wall, opposed side walls joined to the bottom wall and extending substantially normal thereto, pressure plate means, and means for mounting the pressure plate means between said side walls for limited movement substantially normal to said bottom wall of said clamp assembly, the improvement comprising:

clamping means comprising an upper member one end of which is pivotally mounted between said walls and a lower member integral with the other end of the upper member, at least one portion of said lower member comprising a resilient member which engages the upper surface of said pressure plate means when said clamping means is rotated about its said pivotal mounting to closed position and urges at least a portion of the lower surface of said pressure plate member into frictional engagement with said one bracelet section, and the upper member of said clamping means comprising a pair of tab means extending downwardly from opposite sides of said upper member and inwardly beneath the lower surface of said lower member intermediate its ends, thereby to control the force exerted by said resilient member upon the upper surface of said pressure plate means.

6. An adjustable clasp according to claim 5 wherein said lower member also comprises groove means in its lower surface for receiving the ends of said tab means.

7. In an adjustable clasp for interconnecting end sections of a bracelet on the wrist of a wearer including in combination, a clamp assembly for receiving one of the bracelet sections in slidable, adjustable relation, and a coupling assembly secured to the other bracelet section and being engagable with said clamp assembly for interlocking the bracelet on the wrist of a wearer, said clamp assembly comprising a bottom wall, opposed side walls joined to the bottom wall and extending substantially normal thereto, pressure plate means, and means for mounting the pressure plate means between said side walls for limited movement substantially normal to said bottom wall of said clamp assembly, the improvement comprising:

clamping means means for pivotally mounting one end of said clamping means between said side walls of the clamp assembly above a portion of said pressure plate means, said clamping means comprising a resilient member at least one portion of which engages the upper surface of said pressure plate means when said clamping means is rotated about its said pivotal mounting means to closed position and thereby urges at least a portion of the lower surface of said pressure plate means into frictional engagement with said one bracelet section, and the means for mounting the pressure plate means comprising extension members which project outwardly from the ends of the pressure plate means and orifices in said opposed side walls for receiving said extension members and one end of said pressure plate means comprises U-shaped notch means the length of which is greater than the distance between one of said orifices and the upper edge of the adjacent side wall, whereby said extension members of the pressure plate means can be mounted in said orifices without deformation thereof.

8. In an adjustable clasp for interconnecting end sections of a bracelet on the wrist of a wearer including in combination, a clamp assembly for receiving one of the bracelet sections in slidable, adjustable relation, and a coupling assembly secured to the other bracelet section and being engagable with said clamp assembly for interlocking the bracelet on the wrist of a wearer, said clamp assembly comprising, a bottom wall, opposed side walls joined to the bottom wall and extending substantially normal thereto and cross pin means extending between said side walls, said coupling assembly comprising, frame means, hook shaped tongue means extending outwardly from one end of said frame means, said tongue means being detachably engagable with said cross pin means for interconnecting said coupling assembly to said clamp assembly, a cover member comprising a curved plate having side flanges, means for pivotally connecting said side flanges to said frame means, the flanges of said cover comprising outwardly extending projection means which are engagable with portions of the side walls of the coupling assembly when the cover member is moved about said pivot means into overlying relation with respect to said clamp assembly, and said bottom wall of said clamp assembly comprising a generally U-shaped opening extending inwardly from one of its ends making the adjacent portions of the side walls of the clamp assembly more resilient for permitting said outwardly extending projection means of said cover to pass between said resilient portions of said side walls with less friction.

9. An adjustable clasp according to claim 8 wherein said frame means comprises an extension member at its end which is opposite to said tongue means and weldments for securing said extension member to said other bracelet section.

* * * * *